US005226833A

United States Patent [19]

Lwee

[11] Patent Number: 5,226,833

[45] Date of Patent: Jul. 13, 1993

[54] ELECTRICAL CONNECTOR

[75] Inventor: Nai H. Lwee, Fremont, Calif.

[73] Assignee: E. I. du Pont de Nemours and Company, Wilmington, Del.

[21] Appl. No.: 934,824

[22] Filed: Aug. 24, 1992

[30] Foreign Application Priority Data

Aug. 23, 1991 [JP] Japan ..... 3-212468
Dec. 26, 1991 [JP] Japan ..... 3-107467

[51] Int. Cl.[5] ..... H01R 13/00
[52] U.S. Cl. ..... 439/326
[58] Field of Search ..... 439/296, 326-329, 439/629-637

[56] References Cited

U.S. PATENT DOCUMENTS 4,713,013 12/1987 Regnier et al. ..... 439/326
5,094,624 3/1992 Bakke et al. ..... 439/326

*Primary Examiner*—Joseph H. McGlynn

[57] ABSTRACT

An electrical connector including a slot in a surface of a housing of the connector; a pair of latch members molded integrally with the housing and provided one at each end of the slot so as to hold a daughter board in a sandwiched relation; and a reinforcing resilient plate located behind the respective latch member. When the daughter board is detachably mounted on the connector, any excessive flexing of the latch member is restricted by the reinforcing plate.

6 Claims, 11 Drawing Sheets

ELECTRICAL CONNECTOR

BACKGROUND OF THE INVENTION

Field of the Invention

The present invention relates to an electrical connector for electrically and mechanically connecting, for example, a daughter board to a mother board.

Description of the Related Art

Various types of electrical connectors have been known which make a mechanical/electrical connection between, for example, a memory control board called a "mother board" and daughter board, such as a single-in-line memory module (SIMM).

This type of electrical connector has a plastic housing mounted on the mother board. The housing has a slot where the base end of the daughter board is inserted. Contact terminals are provided in the slot to allow an electrical connection to be made between the mother board and the daughter board. A pair of latch members are located one at each end of the slot to hold the daughter board in a sandwiched relation.

The daughter board, after being inserted into the slot, is rotated between the paired latch members. During the rotation, the latch members are pushed out by the side edges of the daughter board and elastically flexed away from each other. When the daughter board attains a predetermined attitude, the latch members are elastically returned back to their initial configuration and hold the daughter board in a sandwiched relation. In this way, the daughter board is set in a predetermined position. The latch members are normally molded integrally with a housing.

Alternatively, an electrical connector as disclosed in U.S. Pat. No. 4,986,765 has metal latch members. The metal latch members are inserted into box-like members molded integral with both ends of a housing so that they may be held relative to the housing.

The plastics latch members are soft and hence flexible. The nature of this material ensures ready attachment and detachment of the daughter board to and from the latch members, but it is not possible to obtain adequate durability to loads. When the daughter board is attached and detached to and from the latch members many times, the latch members are difficult to return back to their initial configuration due to fatigue involved. As a result, the daughter board is held with a poor holding power, readily leading to a defect of an electrical connection between the daughter board and contact terminals. As the case may be, the latch member is sometimes broken or fractured due to a crack, fissure, bend, etc.

On the other hand, metal latch members reveal excellent durability because of their strong nature of material, but this involves a poor operability since a strong force is required upon their attachment and detachment relative to the housing.

SUMMARY OF THE INVENTION

It is accordingly an object of the present invention to provide an electrical connector having latch members of high durability and operability.

In order to achieve the object of the present invention, there is provided an electrical connector for connecting a first circuit board to a second circuit board having a base end, comprising:

a housing molded from an elastic insulating material and having a first surface to be attached to the first circuit board and a second surface receiving the second circuit board, the second surface having at least one groove so dimensioned as to receive the base end of the second circuit board;

contact terminals arranged in the groove and making an electrical connection between the first and second circuit boards;

a pair of engaging members molded integral with the housing and extending from the second surface at those areas near both ends of the groove, the engaging members engaging the second circuit board to hold the second circuit board in a predetermined latched state;

a pair of latch members molded integral with the housing, extending from the second surface of the housing and located in an opposed relation with the pair of engaging members interposed to allow both side edges of the second circuit board to be held in a sandwiched relation;

a pair of projection members molded integral with the housing, extending from the second surface of the housing and located in an opposed relation with the pair of latch members interposed; and a pair of restricting members provided on the second surface of the housing, located in an opposed relation with the pair of latch members interposed, having one end supporting the corresponding latch member in a contacting state and the other end fixed on the housing and an opening provided at an area between said one end and said other end and fitted over the projection member in an engaged state, and, when the second circuit board is inserted into the groove in the housing, elastically restricting flexing of these holding members in a direction to move the opposed latch members away from each other.

The restricting member is preferably made up of an elastic metal member.

The connection may further include a fixing means for fixing said other end of the restricting member to the housing. In one embodiment of the present invention, the fixing means comprises a pair of projections molded integral with the housing, extending from the second surface of the housing and located in an opposed relation with the paired projection members interposed, and an engaging section provided on said other end of the restricting member and detachably fitted over the projection of the fixing means.

In a further embodiment of the present invention, the fixing means is comprised of a leg section by which the restricting member is mounted in the second surface portion of the housing, the leg section being formed integral with the restricting member.

Preferably, the latch member has a handle member for manually flexing the latch member.

According to the electrical connector of the present invention, the restricting member serves as a reinforcing member for reinforcing the latch member and prevents a damage to the latch member.

Since the latch member is molded from the same insulating resin as that of the housing, it is easier to flex and it is thus possible to achieve the readiness with which the second circuit board is detachable from the paired latch members.

DETAILED DESCRIPTION OF THE PREFERRED EMBODIMENTS

Figure 1:
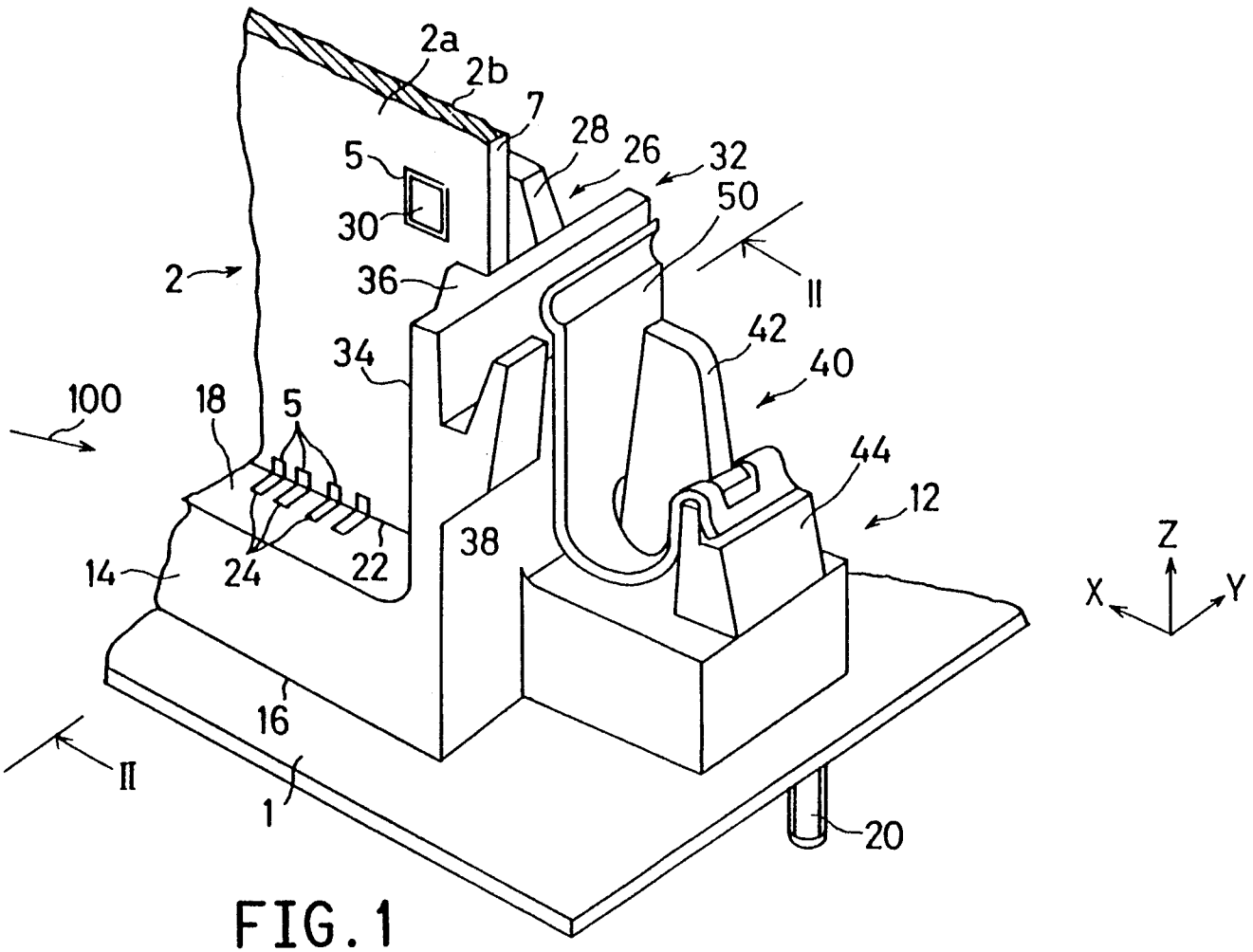
FIG. 1 is a perspective view showing an electrical connector, according to a first embodiment of the present invention, which electrically connects a daughter board to a mother board.

FIG. 1 shows an electrical connector 12 of the present invention before it is assembled. The electrical connector 12 is of such a type that its right end portion is in a substantially mirror image relation to its left end portion as viewed in a right/left direction, the right end portion only of the electrical connector being shown in FIG. 1.

The electrical connector 12 mechanically and electrically connects a mother board 1 to a daughter board 2. The mother board 1 constitutes, for example, a memory control board. The daughter board 2 is of a single-in-line memory module (SIMM) type on which, for example, a memory chip is mounted. The daughter board 2 has an opening 3 at each end portion as viewed in a width direction. A plurality of solder pads 5 are arranged on the base end portion of the daughter board 2. Reference numerals 2*a* and 2*b* show the major and rear surfaces of the daughter board 2, respectively.

The connector 12 has an elongated housing 14 molded from an elastic insulating material, such as plastics. In the following description, X denotes a longitudinal direction of the housing 14 and width direction of the daughter board 2; Y, a transverse direction of the housing 14; and Z, a height direction of the housing 14.

A bottom surface 16 of the housing 14 provides a surface on which the mother board 1 is mounted. A top surface 18 of the housing 14 provides a surface on which the daughter board 2 is mounted.

A leg 20 is provided at each end portion of the mother board mount surface 16 of the housing 14. The legs 20 are inserted through the mother board 1 and fixed, by soldering, etc., to the mother board 1 for electrical connection. By so doing, the connector 12 is mounted on the mother board 1.

A slot 22 is provided, along the X direction, in the daughter board mount surface 18 of the housing 14. A plurality of contact terminals 24 are provided along the X direction in the slot 22 of the daughter board mount surface.

Figure 2:
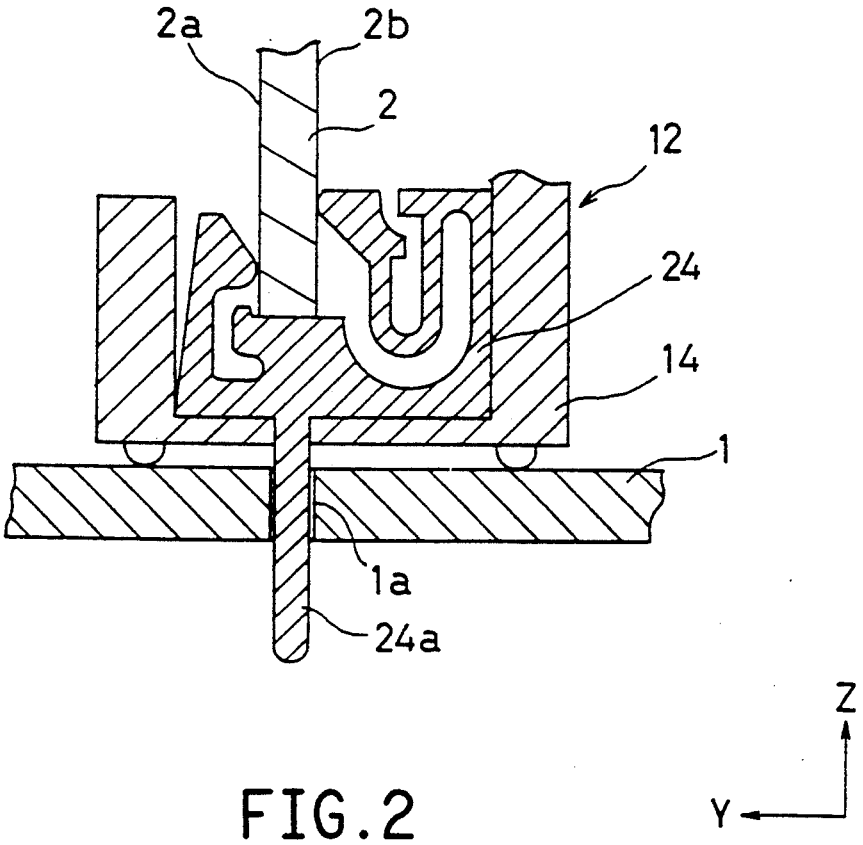
FIG. 2 is a view, as taken along II—II in FIG. 1, showing a contact terminal in a housing in the connector of FIG. 1.

The contact terminals 24 can properly be selected from, for example, those known elastic contact terminals for SIMM. The contact terminal 24 may be of such a type that it has a cross-section as shown, for example, in FIG. 2. The contact terminal 24 is electrically connected to the mother board 1 by a proper method, such as inserting its one end portion 24*a* into a corresponding through hole la in the mother board 1.

Figure 3:
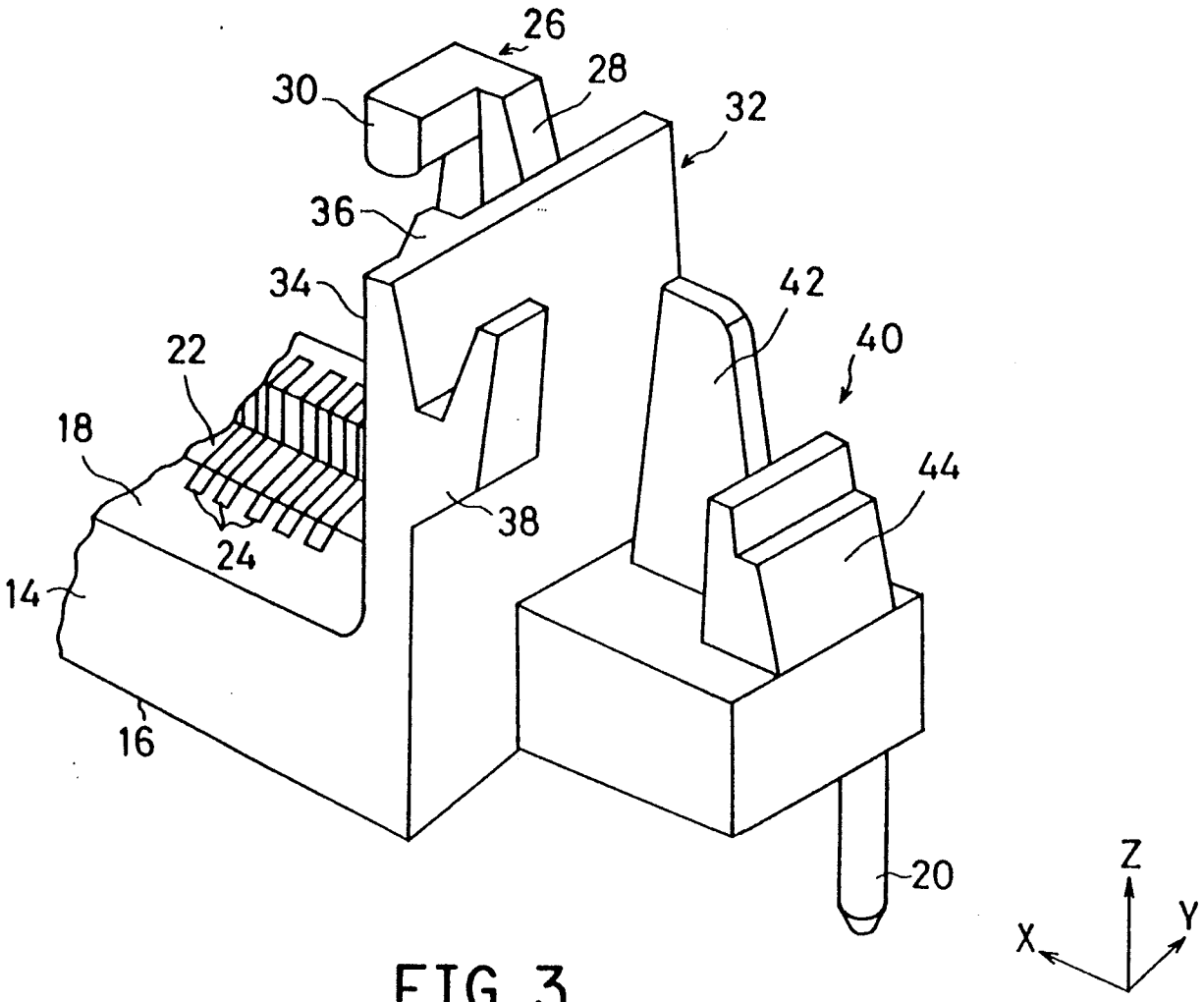
FIG. 3 is a perspective view showing the electrical connector of FIG. 1 before it is assembled.
Figure 4:
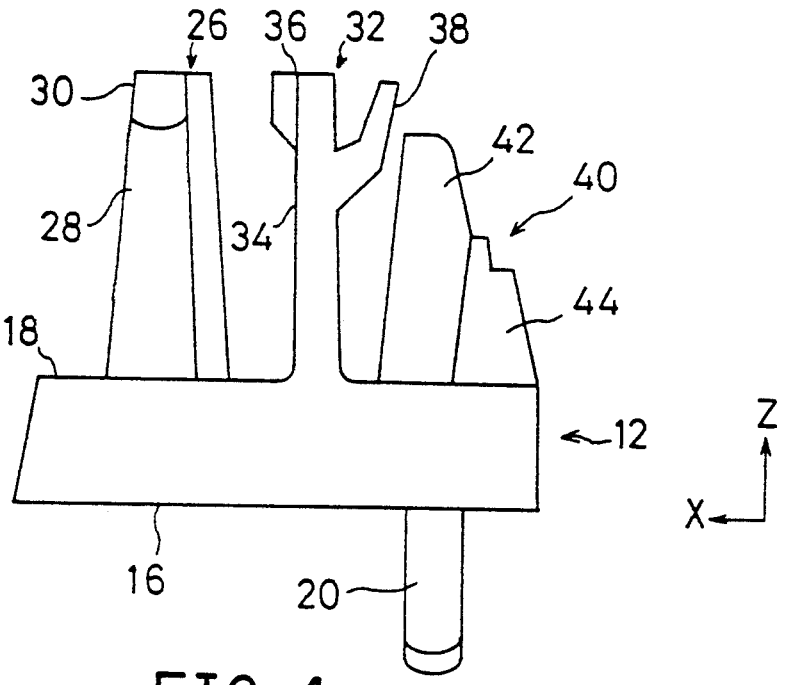
FIG. 4 is a front view showing the electrical connector of FIG. 1.

As shown in FIGS. 3 and 4 in particular, a pair of engaging members 26 are provided one at each end of the slot 22 in the daughter board mount surface 18 and extend upwardly. The engaging member 26 comprises a post 28 and upper boss 30. The boss 30 engages the daughter board's opening 5 from the rear surface side of the daughter board 2.

A pair of wall-like latch members 32 are provided on the daughter board mount surface 18 of the housing 14 with the pair of engaging members 26 interposed. The pair of latch members 32 have support surfaces 34 for supporting side faces or edges 7 of the daughter board. A support projection 36 is provided on the upper end portion of the support surface 34 such that it can support the side edge portion of the major surface 2*a* of the daughter board. The latch member 32 is elastically deformable in the X direction.

The engaging member 30 and latch member 32 are so molded that they are made integral with the housing 14.

In the initial state of the latch members 32, the distance between the paired support surfaces 34 is made somewhat smaller than the X-direction width of the daughter board 2 so that both the side edges of the daughter board 2 may be elastically held, by the latch members, in a sandwiched relation. The latch member 32 preferably has a handle 38 for manually releasing the latched state of the daughter board 2.

A pair of mount members 40 are projected on the daughter board mount surface 18 with the pair of latch members 32 interposed. The mount member 40 is used to mount a reinforcing metal board 50 on the housing as will be set out below. The respective mount lever 40 comprises a rib-like projection member 42 and a block-like engaging member 44.

Figure 5:
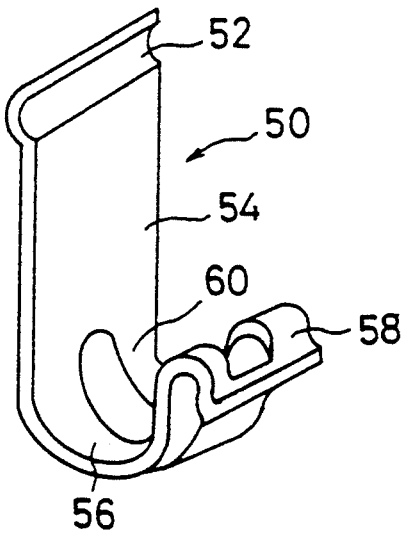
FIG. 5 is a perspective view showing a reinforcing metal plate in FIG. 1.

As shown in FIG. 5 in particular, the reinforcing metal plate 50 is formed by a stamping/bending step from a single elastic metal sheet and has a simple structure. The metal sheet 50 comprises a flat-sheet section 54 and a bending section 56 and hence provides a substantially J-like cross-section. It is to be noted that the bending section has an inverted U-shaped cross section at the free end side. The upper end portion 52 of the flat-sheet section 54 is desirably rounded as indicated in FIG. 5 so as to prevent the latch member 32 from being injured by its upper end edge. The metal plate 50 has an opening 60 formed by a stamping method and extending from the base end portion of the flat-sheet section 52 toward the neighborhood of the free end 58 of the bending section 54.

The electrical connector 12 can be assembled by inserting the rib-like projection member 42 into the opening 60 in the reinforcing metal plate 50 and temporarily mounting the reinforcing metal plate on the housing 14. Thus the assembling operation of the electrical connector 12 becomes easier.

With the reinforcing metal plate 50 temporarily mounted on the housing 14, the U-shaped free end portion 58 of the reinforcing metal plate 50 is fitted on the engaging projection 44 of the mount member 40 and, by so doing, the reinforcing metal plate 50 is detachably fixed to the housing 14. In this case, as shown in FIG. 1, the back surface of the flat-sheet section 52 of the reinforcing metal plate 50 are set in contact with the back surface of the latch member 32 so that the latch member 32 is supported by the metal plate 50.

When the latch members 32 are pushed out in a direction to be moved away from each other, any excessive flexing of the latch member 32 is restricted by the elasticity of the reinforcing metal plate 50, preventing an injury to the latch member 32.

The reinforcing metal plate 50 restricts the flexing of the latch member 32 and is simply not of such a type that an added holding power is applied to the daughter board in a sandwiched relation as in the case of a metal latch member disclosed in U.S. Pat. No. 4,986,765. It is only necessary to apply less power with which the daughter board is attached and detached.

Further, the rib-like projection member 42 serves as a stopper against an excessive load which may be applied to the latch member 32. This structure further ensures the prevention of a damage to the latch member 32.

When the daughter board 2 is to be mounted on the electrical connector 12, the base end of the daughter board 2 is inserted into the slot 22 in an oblique direction 100 (see FIG. 1). Then the daughter board 2 is rotated toward the engaging member 26. During the rotation, the support surfaces 34 of the paired latch members 32 are pushed out by the side face or edge 7 of the daughter board, causing the paired latch members 32 to be elastically deformed in a direction to be moved away from each other.

When the base end of the daughter board 2 is seated on the contact terminals, the boss 30 of the latch member 26 is fitted in the corresponding opening 5 of the daughter board. At the same time, the latch member 32 is elastically returned back to its initial state and the support surfaces 34 of the paired latch members 32 abut against the side edges 7 of the daughter board so that the paired latch members hold the daughter board 2 in the sandwiched relation.

When the daughter board 2 is to be detached from the connector 12, the paired latch members 32 are pushed out in a direction to be moved away from each other. This operation is readily performed by using a pair of handles 38 each provided integral with the latch member 32. By so doing, the daughter board 2 can be unlatched from the paired latch members 32. The unlatched daughter board 2 can be vertically withdrawn out of the connector freely clear of the paired latch members.

Upon the attachment and detachment of the daughter board 2 to and from the housing, any excessive flexing of the latch member 32 is restricted by the reinforcing metal plate 50. Further, the rib-like projection member 42 offers a resistance to the flexing of the latch member 32. As a result, the latch member 32 is prevented from being injured, ensuring enhanced durability.

Figure 6:
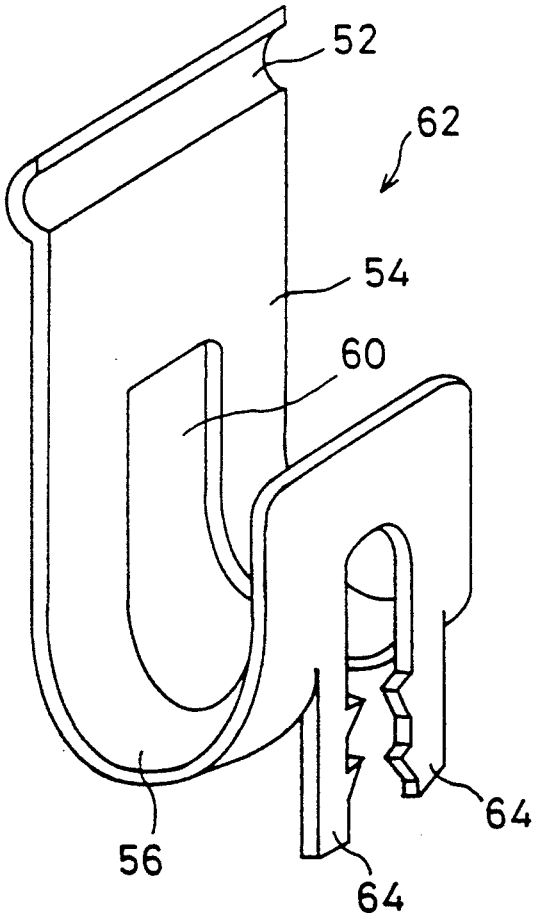
FIG. 6 is a perspective view showing a reinforcing metal plate in a second embodiment of the present invention.
Figure 7:
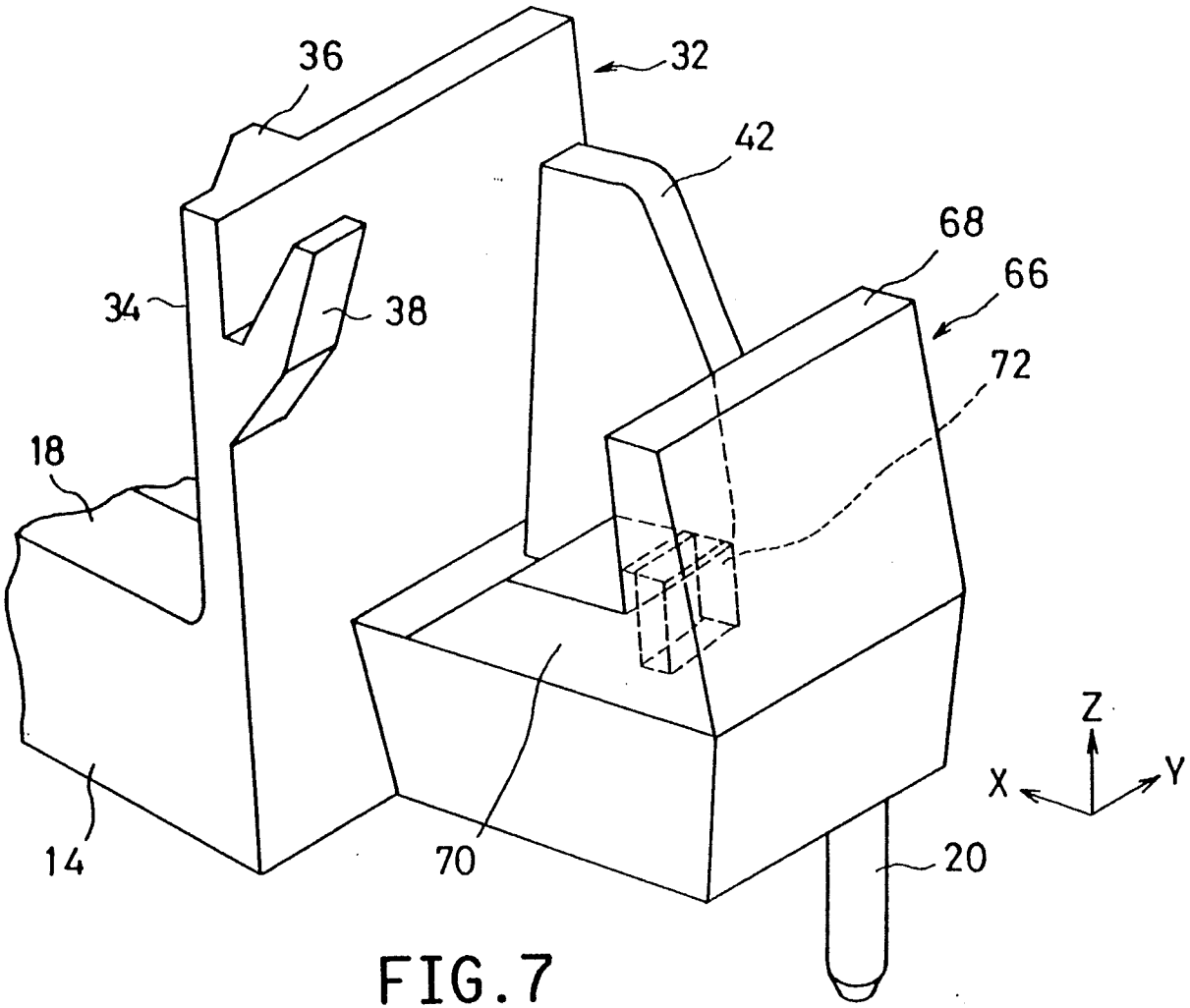
FIG. 7 is a perspective view showing a housing in the second embodiment of the present invention.
Figure 8:
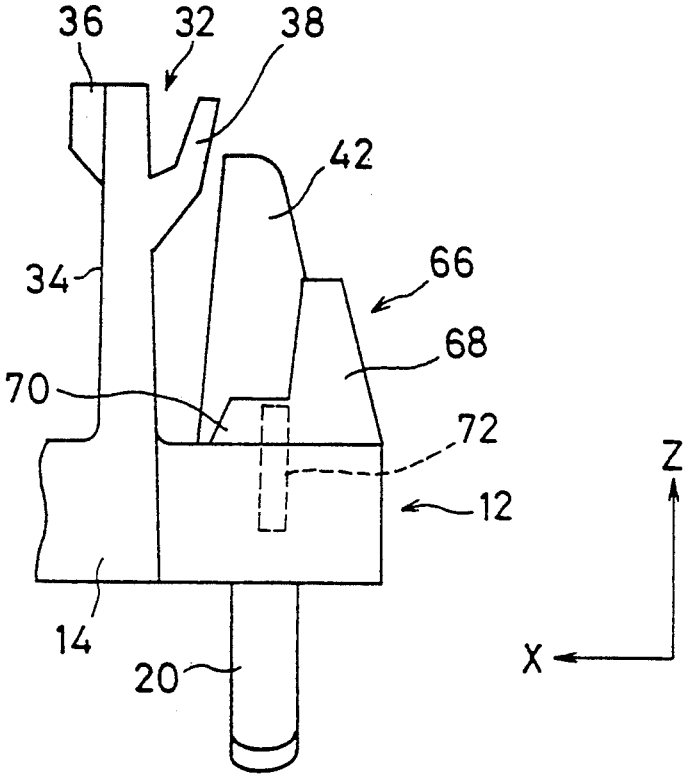
FIG. 8 is a front view showing the housing in the second embodiment.
Figure 9:
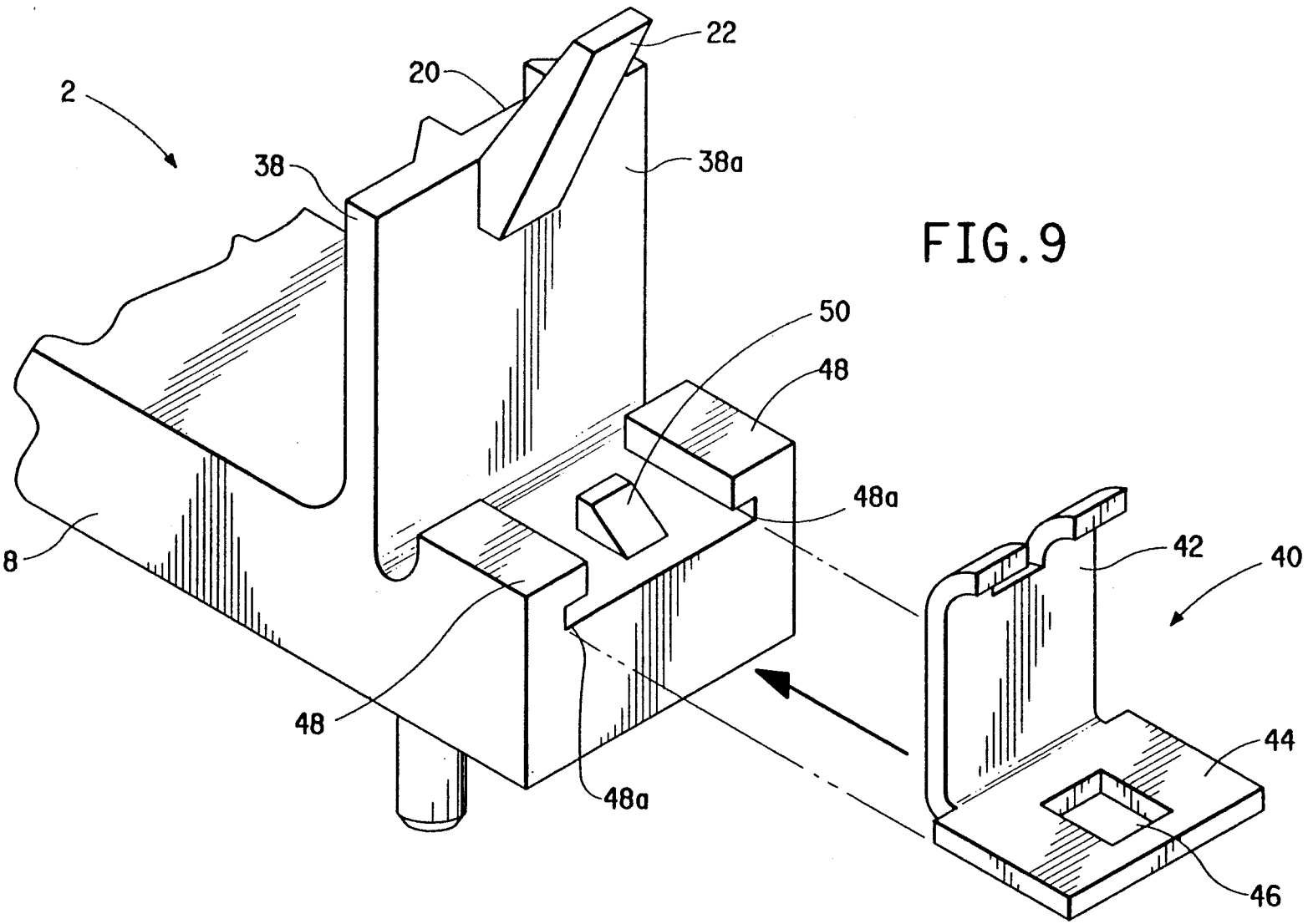
FIG. 9 is a perspective view showing a reinforcing metal plate and the respective latch member before assembly in a third embodiment of the present invention.

FIGS. 6 to 8 show a second embodiment of the present invention. An explanation will be given, below, of only different parts or elements of the second embodiment from those of the previous embodiment.

As shown in FIG. 6, a reinforcing metal plate 62 in the second embodiment is not of such a type that the U-shaped free end portion 58 is provided on the reinforcing metal plate 50 as in the previous embodiment. A pair of holding spikes 64 extend down from a bending section of the reinforcing metal plate 62. The holding spikes 64 are formed by raising the bending section along partially cut lines.

As shown in FIGS. 7 and 8, a pair of support members 66 are provided on a daughter board mount surface 18 of the housing 14, in place of the paired engaging projections 44, in which case the support members 66 is molded integral with the housing 14. The support member 66 comprises a wall-like section 68 projecting at the end of the housing 14 and a raised section somewhat higher than the daughter board mount surface 18. A slot 72 is provided in the raised section 70 over a range from the top surface of the raised section 70 to the housing so that the holding spikes 64 of the reinforcing metal plate 62 can be inserted into the slot.

When the reinforcing metal plate 62 is to be mounted on the housing 14, the rib-like member 42 of the housing 14 is inserted into the opening 60 of the reinforcing metal plate 42 and, at the same time, the holding spikes are inserted into the slot 72 to an extent that it bites the slot wall of the housing 14. In this state, the free end portion of the bending section 56 of the reinforcing metal plate 62 abuts against the wall-like section 68 such that it is supported by the wall-like section 68 of the support member 66. By so doing, the reinforcing metal plate 62 is positively fixed to the housing 14.

FIGS. 9–12 show a third and fourth embodiment of the present invention. For convenience, only one side of a pair of latches and a pair of reinforcing plates are shown.

In FIGS. 4 and 5, latches (38) of a pair of latches (36) include engaging portions (20) and handles (22). The outer side of latch (38) forms a wall **(38*a*)** in nearly flat plate shape.

Reinforcing plate (40) is an elastic metal plate with an L crosssectional shape and is made of a flat plate-shaped support plate (42) facing latch wall **(38*a*) and a bottom plate (44) which can be mounted or detached at will with respect to housing (8). On bottom plate (44), a hole (46) for fitting with projection (50) of housing (8) to be described later is formed. Plate (40)** may be formed by stamping from phosphor bronze, for example.

On the other hand, at the two end portions of housing (8), sliding guides (48), which support bottom plates (44) of plate (40) from its two edges in the width direction while guiding their sliding motion toward latches (38), are formed. Each sliding guide (48) has a pair of groove-shaped guiding passages **(48*a*). In guiding passages (48*a*), the two edges of bottom plate (44)** in the width direction are inserted.

Between the pair of guiding passages **(48*a*), a projection (50) protruded from housing (8) is arranged. When plate (40) is mounted on housing (8), projection (50) is guided along sliding guide (48) and is fit into hole (46) on bottom plate (44). In this way, plate (40) is fixed at the fixing position. At this fixing position, support leg (42) of plate (40) is in contact with latch wall (38*a*) and supports deflection of latch wall (38*a*)** in the outward direction of the housing.

As latches (38) are deflected when daughter board (6) is mounted or detached, support legs (42) of plates (40) support latch walls **(38*a*) face to face, and elastic deformation takes place with composite elastic characteristics that combine both the elastic characteristics of latch (36) and the elastic characteristics of plate (40). In this way, by appropriately adjusting the elastic characteristics of plates (40), it is possible to control the deflection of latch (36). As a result, the insertion/detachment operation of daughter board (6) can be performed easily and smoothly. Also, plate (40) also acts as a reinforcer of latches (38), so that the durability of latch (38**) can be further improved.

Figure 10:
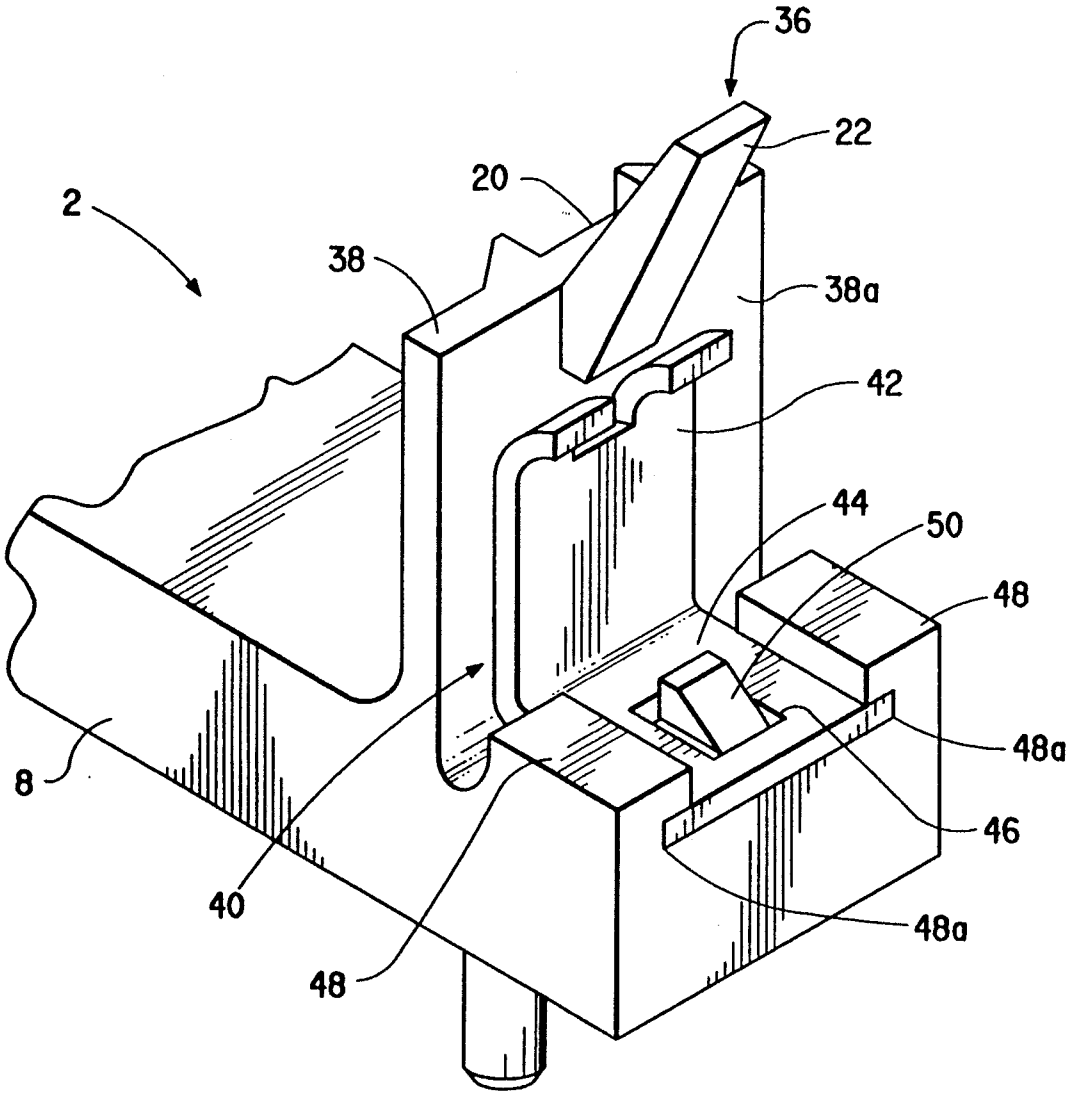
FIG. 10 is a perspective view of the assembled embodiment of FIG. 9.
Figure 11:
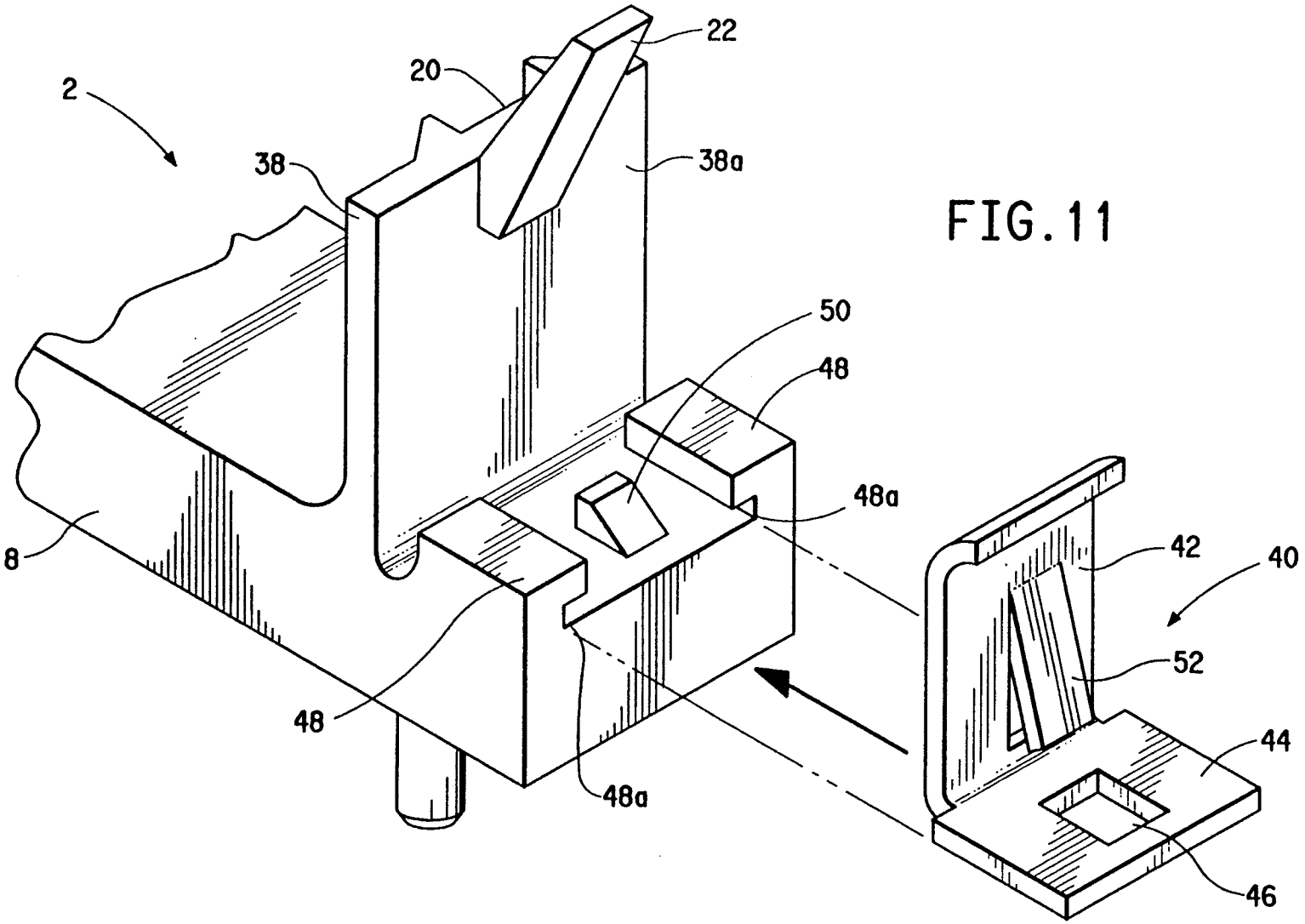
FIG. 11 is a perspective view showing a reinforcing metal plate and the respective latch member before assembly in a fourth embodiment of the present invention.
Figure 12:
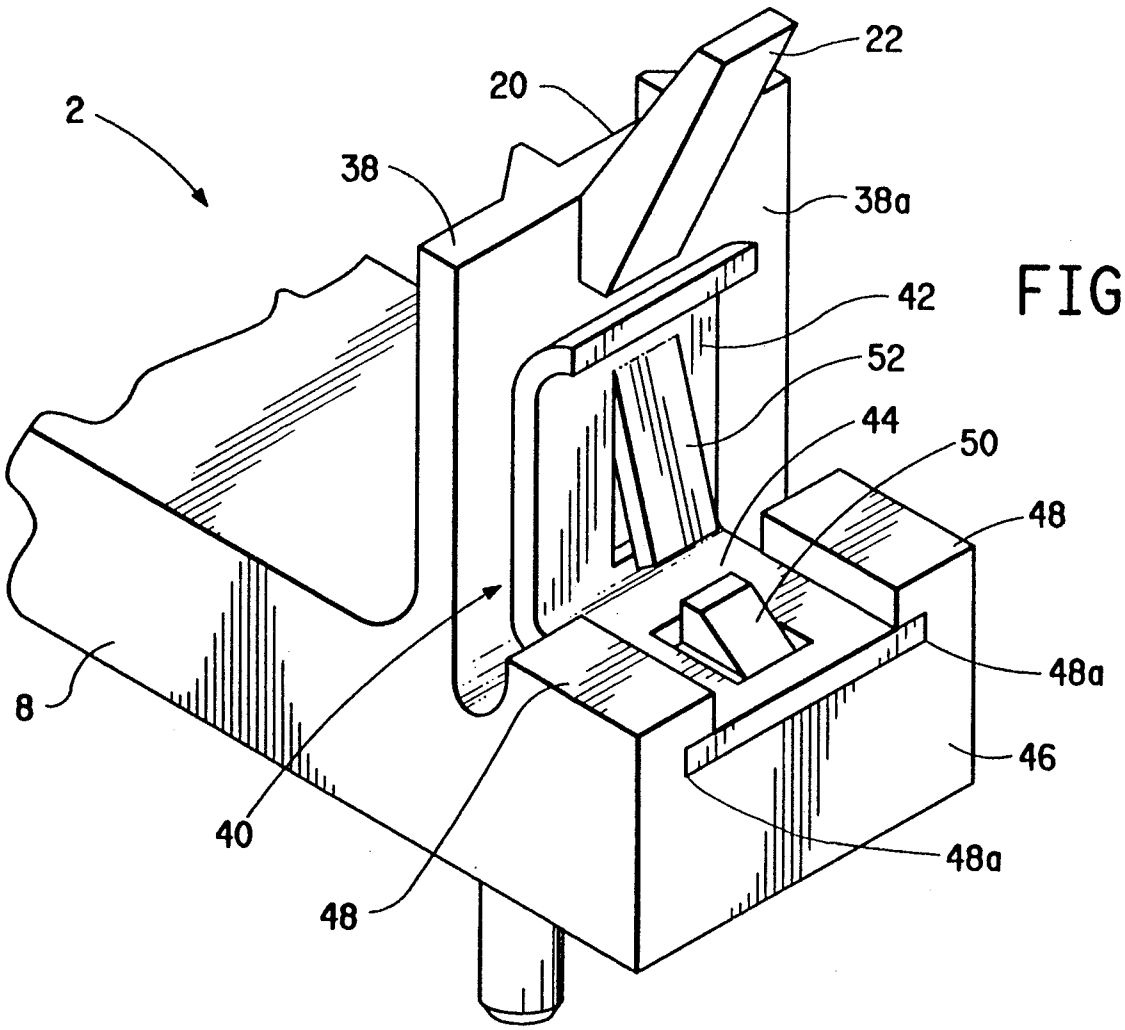
FIG. 12 is a perspective view of the assembled embodiment of FIG. 11.

FIGS. 10 and 11 show the fourth embodiment of this invention. This is an example of a modification of the design of plate (40) in the third embodiment. On support leg (42) of plate (40), a tongue-shaped sheet (52) is formed by cutting. When plate (40) is to be mounted or removed with respect to housing (8), handling of plate (40) can be facilitated by pressing down the tongue-shaped sheet (52). The other effects are the same as those the third embodiment.

The electrical connector of the present invention is not restricted to the aforementioned embodiments. Various changes or modifications of the present invention can be made without departing from the spirit and scope of the present invention. Although the daughter board 2 has been explained as being mounted on the electrical connector 1 in a manner to take a vertical position, it may be done in a manner to take a horizontal or oblique position.

Further, a plurality of daughter boards may be mounted on the electrical connector.

According to the electric connector of the present invention, the flexing of the latch member is restricted by the restricting member. As a result, the latch member has enhanced durability and ensures a stable, firm holding power even if repeated attachment and detachment have been effected relative to the housing.

Further, the latch members are molded integral with the housing as in the conventional connector and hence are simpler in construction, thus making it possible to reduce the manufacturing cost of the housing.

What is claimed is:

1. An electrical connector for connecting a first circuit board to one second circuit board having a base end, comprising:

a housing molded from an elastic insulating material and having a first surface to be attached to the first circuit board and a second surface receiving the second circuit board, the second surface having at least one groove so dimensioned as to receive the base end of the second circuit board;

contact terminals arranged in the groove and making an electrical connection between the first and second circuit boards;

a pair of engaging members molded integral with the housing and extending from the second surface at those areas near both ends of the groove, the engaging members engaging the second circuit board to hold the second circuit board in a predetermined latched state;

a pair of latch members molded integral with the housing, extending from the second surface of the housing and located in an opposed relation with the pair of engaging members interposed to allow both side edges of the second circuit board to be held in a sandwiched relation;

a pair of projection members molded integral with the housing, extending from the second surface of the housing and located in an opposed relation with the pair of latch members interposed;

a pair of restricting members provided on the second surface of the housing, located in an opposed relation with the pair of latch members interposed, having one end contacting the corresponding latch member, the other end fixed on the housing and an opening provided between said one end and said other end and fitted over the projection member in an engaged state, and, when the second circuit board is inserted into the groove in the housing, elastically restricting the flex of the latch members in a direction away from each other.

2. The electrical connector according to claim 1, wherein the restricting member is made up of an elastic metal member.

3. The electrical connector according to claim 1, wherein the latch member has a handle member for manually flexing the latch member.

4. The electrical connection of claim 1 further comprising:

fixing means for fixing said other end of the restricting member to the housing.

5. The electrical connector according to claim 4, wherein the fixing means comprises a pair of projections molded integral with the housing, extending from the second surface of the housing and located in an opposed relation with the paired projection members interposed, and an engaging section provided on the other end of the restricting member and detachably fitted over the projection of the fixing means.

6. The electrical connector according to claim 4, wherein the fixing means is comprised of a leg section by which the restricting member is mounted in the second surface portion of the housing, the leg section being formed integral with the restricting member.

* * * * *